US008845090B2

(12) United States Patent
Onodera et al.

(10) Patent No.: US 8,845,090 B2
(45) Date of Patent: Sep. 30, 2014

(54) INK JET PRINTER, OBJECT-TO-BE-PRINTED HOLDING MEMBER, AND PRINTING METHOD

(71) Applicant: Mimaki Engineering Co., Ltd., Tomi (JP)

(72) Inventors: Akihiro Onodera, Hachioji (JP); Masashi Hirano, Hachioji (JP); Toshihiro Sanuki, Hachioji (JP)

(73) Assignee: Mimaki Engineering Co., Ltd., Tomi (JP)

( * ) Notice: Subject to any disclaimer, the term of this patent is extended or adjusted under 35 U.S.C. 154(b) by 0 days.

(21) Appl. No.: 14/066,692

(22) Filed: Oct. 30, 2013

(65) Prior Publication Data

US 2014/0118453 A1 May 1, 2014

(30) Foreign Application Priority Data

Oct. 30, 2012 (JP) ..... 2012-239626

(51) Int. Cl.

| | |
|---|---|
| ***B41J 2/01*** | (2006.01) |
| ***B41J 3/407*** | (2006.01) |
| ***B41J 11/06*** | (2006.01) |
| ***B41J 3/28*** | (2006.01) |

(52) U.S. Cl.

CPC *B41J 2/01* (2013.01); *B41J 3/4073* (2013.01); *B41J 11/06* (2013.01); *B41J 3/28* (2013.01)

USPC ..... 347/104; 347/102

(58) Field of Classification Search

USPC ..... 347/101, 102, 103, 104, 105, 106

See application file for complete search history.

(56) References Cited

U.S. PATENT DOCUMENTS

| | | | | |
|---|---|---|---|---|
| 5,059,266 | A * | 10/1991 | Yamane et al. | 156/64 |
| 5,287,435 | A * | 2/1994 | Cohen et al. | 345/418 |
| 6,520,084 | B1 * | 2/2003 | Gelbart | 101/401.1 |

FOREIGN PATENT DOCUMENTS

| | | | |
|---|---|---|---|
| JP | 2010-158874 | A | 7/2010 |
| JP | 2011-020112 | A | 2/2011 |

* cited by examiner

*Primary Examiner* — Ahn T. N. Vo

(74) *Attorney, Agent, or Firm* — Park, Kim & Suh, LLC

(57) ABSTRACT

When printing on 3-dimensional objects such as covers for handheld terminals, generation of stray light may be adequately suppressed. There is provided an ink jet printer including an ink jet head, an ultraviolet irradiating portions, and an object-to-be-printed holding member, wherein the object-to-be-printed holding member includes a 3-dimensional object holding portion configured to hold a 3-dimensional object, and a light-shielding portion, the 3-dimensional object holding portion changes an orientation of the 3-dimensional object to bring a first surface to be printed and a second surface to be printed respectively to oppose the ink jet head, the light-shielding portion is provided so as to be capable of advancing and retracting in a direction of discharge at least at some position, and changes a shielding area that shields ultraviolet rays in a direction orthogonal to the direction of discharge.

19 Claims, 3 Drawing Sheets

(a)

(b)

INK JET PRINTER, OBJECT-TO-BE-PRINTED HOLDING MEMBER, AND PRINTING METHOD

This application claims the benefit of Japanese Patent Application No. 2012-239626, filed on Oct. 30, 2012 in Japan, which is hereby incorporated by reference as if fully set forth herein

BACKGROUND OF THE INVENTION

1. Field of the Invention

The present invention relates to an ink jet printer, an object-to-be-printed holding member, and a printing method.

2. Description of the Background Art

In recent years, objects to be printed of an ink jet printer are not only flat media such as paper or films, but also 3-dimensional objects having various shapes. In association with this tendency, a method of holding printed objects (works) having various shapes are also studied. For example, in the related art, a method of performing three-dimensional printing continuously by mounting the work on a rotating unit is known (for example, see JP-A-2011-20112). There is also a known method in which when printing on a rotating body having a plurality of ink droplets landing surfaces as a work, a printing operation is performed while rotating the rotating body (see JP-A-2010-158874).

In recent years, with glowing popularization of handheld terminals such as smart phones, covers for such handheld terminals are now in increasing demand. Accordingly, the inventors of the present application have studied earnestly about how to hold works when printing on 3-dimensional objects like covers for the handheld terminals such as smart phones with an ink jet printer.

When printing on the covers for the handheld terminals, printing not only on surfaces which cover back surfaces of the terminals, but also on side surfaces which intersect the back surfaces is desired. Since the covers for the handheld terminals are products which are required to be excellent in design, printing with great precision is desired. On the other hand, since the prices of these products are low in comparison with those of main bodies of the handheld terminals, printing with lower costs is desired.

In order to realize these desires, the inventors of the present application have studies earnestly firstly about the method of printing on works having a shape such as the covers for the handheld terminals more adequately with the ink jet printer. Consequently, the inventors have found that adequate printing on each of the surfaces of the works is achieved by mounting the works such as the cover of the handheld terminals on shaft members and rotating the shaft members to change the orientation of the works.

The inventors of the present application also have studied about problems occurring newly when printing on the works in this method. Consequently, the inventors have found that when the printing is performed with the configuration described above by using ultraviolet curing ink, there may occur a problem of leakage of stray light from positions where the ultraviolet rays to be irradiated for curing the ink are deviated.

More specifically, in a case where printing on works such as covers for handheld terminals, for example, when changing the orientation of the works by rotating shaft members on which the works are mounted, in order to set surfaces which cover back surfaces of the terminals (main surfaces to be printed) as surfaces to be printed, the rotational position of the shaft members are aligned to predetermined positions so that the main surfaces to be printed oppose an ink jet head. When side surfaces are the surfaces to be printed, the shaft members are rotated so that the side surfaces oppose the ink jet head.

In this case, the position of the surfaces to be printed in the direction of discharge of ink droplets (for example, in the vertical direction) in the case where the main surfaces to be printed are the surfaces to be printed may differ from that in the case where the side surfaces are the surfaces to be printed. When changing the position of the surfaces to be printed, gaps which allow leakage of ultraviolet rays may be created, and hence the problem of stray light may occur.

However, when printing is performed by using the ink jet printer, an operator (user) may perform an operation of the printer in the vicinity of the printer. Therefore, leakage of the ultraviolet rays is not preferable. The leaked ultraviolet rays may cause deterioration of printer components, or resin components in the periphery thereof. Therefore, the amount of the stray light leaked to the position deviated from the work is required to be as small as possible.

SUMMARY OF THE INVENTION

Accordingly, it is an object of the invention to provide an ink jet printer, an object-to-be-printed holding member, and a printing method in which the problems as described above are solved.

In order to solve the above-described problem, the invention provides following configurations.

(Configuration 1)

An ink jet printer configured to perform printing on a 3-dimensional object in an ink jet system including:

an ink jet head configured to discharge ink droplets of ultraviolet curing ink;

an ultraviolet irradiating portion configured to irradiate ultraviolet rays to cure the ultraviolet curing ink; and an object-to-be-printed holding member configured to hold the 3-dimensional object to be printed so as to oppose the ink jet head, wherein the 3-dimensional object to be printed includes at least a first surface to be printed as a surface to be printed by the ink jet printer and a second surface to be printed as a side surface of the first surface to be printed, the object-to-be-printed holding member includes:

a 3-dimensional object holding portion configured to hold the 3-dimensional object so as to oppose the ink jet head; and a light-shielding portion configured to reduce the ultraviolet rays proceeding to an outside of the object-to-be-printed holding member, the 3-dimensional object holding portion changes an orientation of the 3-dimensional object to bring the first surface to be printed and the second surface to be printed to oppose the ink jet head, when bringing the first surface to be printed to oppose the ink jet head, the 3-dimensional object holding portion holds the 3-dimensional object so that a position of the first surface to be printed in the direction of discharge as a direction in which the ink jet head discharges the ink droplets comes to a first opposed position, when bringing the second surface to be printed to oppose the ink jet head, the 3-dimensional object holding portion holds the 3-dimensional object so that a position of the second surface to be printed in the direction of discharge comes to a second opposed position different from the first opposed position, the light-shielding portion is provided apart from the 3-dimensional object held by the 3-dimensional object holding portion in the direction orthogonal to the direction of discharge, and hence shields the ultraviolet rays proceeding to the outside of the object-to-be-printed holding member in at least any one of directions in the periphery of the 3-dimensional object, and the light-shielding portion is provided so at to be capable of advancing and retracting in the direction of discharge at least at part of positions, the 3-dimensional object holding portion advances and retracts corresponding respectively to the first opposed position in a case where the 3-dimensional object holding portion brings the first surface to be printed to oppose the ink jet head and the second opposed position in a case where the second surface to be printed to oppose the ink jet head to change a light-shielding area that shields the ultraviolet rays in the direction orthogonal to the direction of discharge.

In this configuration, for example, when a position of the surface to be printed is changed by changing the orientation of the 3-dimensional object, the light-shielding area shielded by the light-shielding portion may be changed adequately so as to match the position in question. Therefore, in this configuration, stray light leaking to the position deviated from the 3-dimensional object, for example, as a work to be printed may be suppressed adequately.

The 3-dimensional object holding portion rotates the 3-dimensional object about a predetermined shaft to bring the first surface to be printed and the second surface to be printed to oppose the ink jet head. The 3-dimensional object to be printed is, for example, a cover for a handheld terminal such as a smart phone. The light-shielding portion shields ultraviolet rays on the side of a housing portion of the object-to-be-printed holding member closer to the ink jet head or in the vicinity thereof (for example, an upper part of the housing portion). The housing portion of the object-to-be-printed holding member is, for example, a portion composed of a side surface fixed in position by the object-to-be-printed holding member.

The term "change the light-shielding area shielded by the light-shielding portion" means, for example, to change the position of the light-shielding portion by advancing and retracting movement, or to change the surface area of an area of the light-shielding portion which contributes to the light shielding may also be applied. The light-shielding portion may perform both of the change of the position and the change of the surface area of the area which contributes to the light shielding by the advancing and retracting operation. The light-shielding portion may change the surface area of the area which contributes to the light shielding to zero by the advancing and retracting operation. In this case, the light-shielding portion may perform the shielding of the ultraviolet rays only in one of a case where the first surfaces to be printed are brought to oppose the ink jet head and a case where the second surfaces to be printed are brought to oppose the ink jet head, and do not have to shield the ultraviolet rays in the other case.

In this case, more specifically, it is conceivable, for example, to use the light-shielding portion configured not only to perform the advancing and retracting operation in the direction of discharge but also to be bent at a portion pushed upward (ink jet head side) by the advancing and retracting operation and moved to an upper surface (ceiling portion) of the object-to-be-printed holding member. In this case, for example, in the other case of the cases described above, the light-shielding portion may be brought into a state not involved in light shielding in the direction orthogonal to the direction of discharge at all by being moved to the ceiling portion. In the one case of the cases described above, the ultraviolet rays may be shielded by the light-shielding portion by moving the light-shielding portion downward from the ceiling portion. Examples of the light-shielding portion configured as described above include a configuration similar to that of a slider type door used in garages for vehicles configured to open a garage by moving a slider to a ceiling portion of the garage.

(Configuration 2)

In a case where the 3-dimensional object holding portion brings the first surface to be printed to oppose the ink jet head, the light-shielding portion shields the ultraviolet rays at a first light-shielding position in the direction of discharge, and in a case where the 3-dimensional object holding portion brings the second surface to be printed to oppose the ink jet head, the light-shielding portion shields the ultraviolet rays at a second light-shielding position different from the first light-shielding position in the direction of discharge.

In this configuration, the light-shielding area shielded by the light-shielding portion may be adequately changed by changing the position of the light-shielding portion by the advancing and retracting operation, for example. Accordingly, for example, stray light leaking to the position deviated from the 3-dimensional object may be suppressed adequately.

(Configuration 3)

The 3-dimensional object holding portion includes: a shaft member extending in the direction orthogonal to the direction of discharge; a shaft holding portion configured to hold the shaft member so as to be rotatable; and a 3-dimensional object fixing member configured to fix the 3-dimensional object to the shaft member and rotates the 3-dimensional object together with the shaft member by being fixed to the shaft member, and the 3-dimensional object holding portion changes an orientation of the 3-dimensional object by rotating the shaft member to brings the first surface to be printed and the second surface to be printed to oppose to the ink jet head.

In this configuration, for example, the respective surfaces to be printed of the 3-dimensional object to be printed may be brought to oppose the ink jet head adequately with great precision. Accordingly, printing with great precision is adequately achieved. The 3-dimensional object fixing member is fixed to the shaft member, for example, in a state in which the shaft member penetrates therethrough. The shaft holding portion may be a side surface configuring the housing portion of the object-to-be-printed holding member or part thereof.

(Configuration 4)

The object-to-be-printed holding member further includes an interlocking member configured to advance and retract the light shielding portion in the direction of discharge in conjunction with the rotation of the shaft member. In this configuration, the light-shielding portion may be advanced and retracted adequately, so as to match the position of the surface to be printed which changes according to the rotation of the shaft member for example. Accordingly, stray light leaking to the position deviated from the 3-dimensional object may further be suppressed adequately.

(Configuration 5)

The interlocking member is an ellipsoidal cam configured to rotate according to the rotation of the shaft member by the shaft member inserted through the center thereof, and advance and retract the light-shielding portion in the direction of discharge in conjunction with the rotation of the shaft member by rotating in a state in contact with the light-shielding portion. In this configuration, the light-shielding portion may be advanced or retracted adequately so as to match the position of the surfaces to be printed which changes according to the rotation of the shaft member. Accordingly, stray light leaking to the position deviated from the 3-dimensional object may further be suppressed adequately.

(Configuration 6)

The 3-dimensional object holding portion includes: at least two shaft members arranged with axial directions parallel to each other; and at least two 3-dimensional object fixing members configured to fix the 3-dimensional objects to the shaft members, the object-to-be-printed holding member includes at least four ellipsoidal cams mounted to both ends of the at least two shaft members, and the light-shielding portion is in contact with the at least two ellipsoidal cams on one end side of the at least two shaft members and the at least two ellipsoidal cams on the other end side of the at least two shaft members, and advances and retracts in the direction of discharge according to the rotation of the at least four ellipsoidal cams.

In this configuration, the light-shielding portion may be advanced and retracted more smoothly and more stably, for example, by causing the light-shielding portion to be advanced or retracted in a state of being held at least at four points. Accordingly, stray light leaking to the position deviated from the 3-dimensional object may further be suppressed adequately.

In this configuration, adequate printing on a number of 3-dimensional objects may be performed simultaneously by using a plurality of shaft members and a plurality of the 3-dimensional object fixing members. Therefore, in this configuration, printing cost may be reduced adequately. In this case, by effectively utilizing the configuration in which the plurality of shaft members are used, advancing and retracting movement of the light-shielding portion may be performed further adequately. Therefore, in this configuration, the stray light may be suppressed more adequately by using, for example, a configuration specific for achieving the printing at low costs.

The light shielding portion includes, for example, a first portion configured to come into contact with ellipsoidal cams on one end side of at least two shaft members and a second portion configured to come into contact with the ellipsoidal cams on the other end side of the at least two shaft members, and a third portion coupling the first portion and the second portion. In this case, the first portion, the second portion, and the third portion of the light-shielding portion advance and retract simultaneously in the direction of discharge in a state in which the relative position thereof is fixed. The first portion, the second portion, the third portion, and the like may be a single continuing member as a whole. At least four ellipsoidal cams are configured to advance and retract the first portion, the second portion, and the third portion of the light-shielding portion in the direction of discharge by coming into contact with the light-shielding portion on both end sides of the at least two shaft members. The light-shielding portion shields the ultraviolet rays by at least one of the first portion, the second portion, and the third portion. The light-shielding portion may further include a fourth portion configured to couple the first portion and the second portion at a position different from the third portion.

(Configuration 7)

The object-to-be-printed holding member further includes an urging member configured to urge the light-shielding portion in the direction away from the ink jet head. In this configuration, for example, the light-shielding portion may be advanced and retracted more adequately by the ellipsoidal cams as interlocking members.

(Configuration 8)

A corrected information memory configured to memorize information for correcting an angle of rotation of the shaft member is further provided. The corrected information memory is, for example, a ROM. In this configuration, for example, the rotation of the shaft members may be controlled with great precision further adequately.

(Configuration 9)

An object-to-be-printed holding member used in an ink jet printer configured to perform printing on a 3-dimensional object in an ink jet system by using ultraviolet curing ink and hold the 3-dimensional object to be printed so as to oppose an ink jet head, the object-to-be printed holding member including: a 3-dimensional object holding portion configured to hold the 3-dimensional object so as to oppose the ink jet head; a light-shielding portion configured to reduce ultraviolet rays proceeding to an outside of the object-to-be-printed holding member, wherein the 3-dimensional object to be printed includes at least a first surface to be printed as a surface to be printed by the ink jet printer and a second surface to be printed as a side surface of the first surface to be printed, the 3-dimensional object holding portion changes an orientation of the 3-dimensional object to bring the first surface to be printed and the second surface to be printed to oppose the ink jet head, when bringing the first surface to be printed to oppose the ink jet head, the 3-dimensional object holding portion holds the 3-dimensional object so that a position of the first surface to be printed in the direction of discharge as a direction in which the ink jet head discharges the ink droplets comes to a first opposed position, when bringing the second surface to be printed to oppose the ink jet head, the 3-dimensional object holding portion holds the 3-dimensional object so that a position of the second surface to be printed in the direction of discharge comes to a second opposed position different from the first opposed position, the light-shielding portion is provided apart from the 3-dimensional object held by the 3-dimensional object holding portion in the direction orthogonal to the direction of discharge, and hence shields the ultraviolet rays proceeding to the outside of the object-to-be-printed holding member in at least any one of directions in the periphery of the 3-dimensional object, and the light-shielding portion is provided so at to be capable of advancing and retracting in the direction of discharge at least at part of positions, the 3-dimensional object holding portion advances and retracts corresponding respectively to the first opposed position in a case where the 3-dimensional object holding portion brings the first surface to be printed to oppose the ink jet head and the second opposed position in a case where the second surface to be printed to oppose the ink jet head to change a light-shielding area that shields the ultraviolet rays in the direction orthogonal to the direction of discharge. In this configuration, the same effect as Configuration 1 may be achieved.

(Configuration 10)

A printing method configured to perform printing in an ink jet system on a 3-dimensional object using: an ink jet head configured to discharge ink droplets of ultraviolet curing ink; an ultraviolet irradiating portion configured to irradiate ultraviolet rays to cure the ultraviolet curing ink; and an object-to-be-printed holding member configured to hold the 3-dimensional object to be printed so as to oppose the ink jet head, wherein the 3-dimensional object to be printed includes at least a first surface to be printed as a surface to be printed by the ink jet printer and a second surface to be printed as a side surface of the first surface to be printed, the object-to-be-printed holding member includes: a 3-dimensional object holding portion configured to hold the 3-dimensional object so as to oppose the ink jet head; and a light-shielding portion configured to reduce the ultraviolet rays proceeding to an outside of the object-to-be-printed holding member, the 3-dimensional object holding portion changes an orientation of the 3-dimensional object to bring the first surface to be printed and the second surface to be printed to oppose the ink jet head, when bringing the first surface to be printed to oppose the ink jet head, the 3-dimensional object holding portion holds the 3-dimensional object so that a position of the first surface to be printed in the direction of discharge as a direction in which the ink jet head discharges the ink droplets comes to a first opposed position, when bringing the second surface to be printed to oppose the ink jet head, the 3-dimensional object holding portion holds the 3-dimensional object so that a position of the second surface to be printed in the direction of discharge comes to a second opposed position different from the first opposed position, the light-shielding portion is provided apart from the 3-dimensional object held by the 3-dimensional object holding portion in the direction orthogonal to the direction of discharge, and hence shields the ultraviolet rays proceeding to the outside of the object-to-be-printed holding member in at least any one of directions in the periphery of the 3-dimensional object, and the light-shielding portion is provided so at to be capable of advancing and retracting in the direction of discharge at least at part of positions, the 3-dimensional object holding portion advances and retracts corresponding respectively to the first opposed position in a case where the 3-dimensional object holding portion brings the first surface to be printed to oppose the ink jet head and the second opposed position in a case where the second surface to be printed to oppose the ink jet head to change a light-shielding area that shields the ultraviolet rays in the direction orthogonal to the direction of discharge. In this configuration, the same effect as Configuration 1 is achieved.

According to the invention, when printing on 3-dimensional objects such as covers for handheld terminals, generation of stray light may be adequately suppressed.

BRIEF DESCRIPTION OF THE DRAWINGS

FIG. 1B illustrates a detailed configuration of the entire ink jet printer 10;

FIGS. 2A to 2C are drawings illustrating an example of a detailed configuration of an object-to-be-printed holding member 18, in which FIG. 2A is a perspective view illustrating an example of the configuration of the object-to-be-printed holding member 18, and FIGS. 2B and 2C are explanatory drawing for explaining the advancing and retracting movement of the light-shielding portion 110 of the object-to-be-printed holding member 18.

FIGS. 3A and 3B are drawings for explaining a state in which a light-shielding portion 110 advances and retracts in association with rotations of a shaft members 102 and an ellipsoidal cams 112, in which FIG. 3A illustrates an example of a state in which printing is performed on main printing surfaces 302 of 3-dimensional objects 50, and FIG. 3B is an example of a state in which printing is performed on side surfaces 304 of the 3-dimensional objects 50.

DETAILED DESCRIPTION OF THE INVENTION

Figure 1:
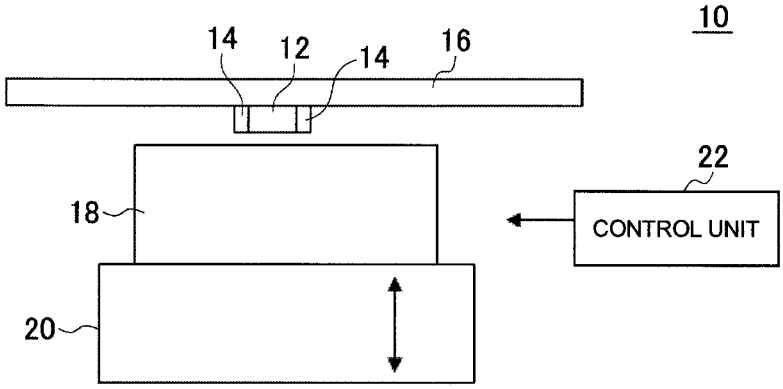
FIGS. 1A and 1B illustrate an example of a configuration of an ink jet printer 10 according to an embodiment of the invention, in which FIG. 1A schematically illustrates a function and a configuration of the ink jet printer 10.
Figure 1:
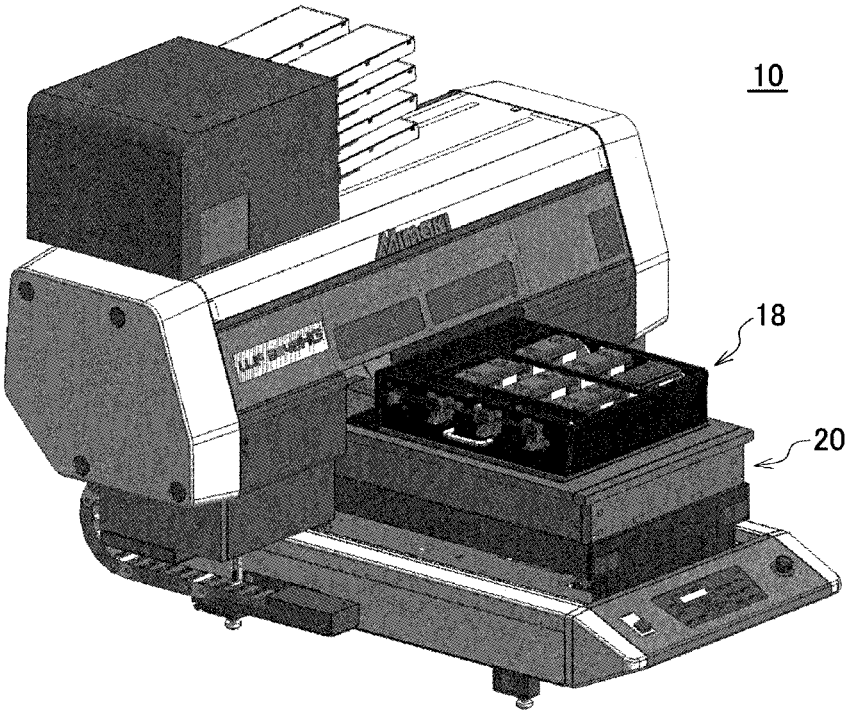

Referring now to the drawings, embodiments of the invention will be described. FIGS. 1A and 1B illustrate an example of a configuration of the ink jet printer 10 according to an embodiment of the invention. FIG. 1A schematically illustrates a function and the configuration of the ink jet printer 10.

In this example, the ink jet printer 10 is a printing apparatus configured to perform printing on 3-dimensional objects in an ink-jet method, and performs the printing on covers for handheld terminals such as smart phones. The cover for the handheld terminal is an example of a 3-dimensional object having at least a first surface to be printed and second surfaces to be printed which are side surfaces with respect to the first surface to be printed. The 3-dimensional object to be printed may be cover-type members other than covers for the handheld terminals.

The ink jet printer 10 includes an ink jet head 12, ultraviolet irradiating portions 14, a guide rail 16, an object-to-be-printed holding member 18, a holding portion drive unit 20, and a control unit 22. The ink jet head 12 is a print head configured to discharge ink droplets on the 3-dimensional objects to be printed. In this example, the ink jet head 12 discharges droplets of ultraviolet curing ink. The ink jet head 12 performs color printing by discharging ink droplets of CMYK respective colors, for example. The ink jet head 12 may further discharge white ink, clear ink, and the like. The ultraviolet irradiating portions 14 are light sources configured to irradiate ultraviolet rays for curing the ultraviolet curing ink.

The guide rail 16 is a rail-shaped member extending in a predetermined primary scanning direction and, at the time of printing, causes the ink jet head 12 to perform a primary scanning action (scanning action). In the scanning action, the ink jet head 12 discharges ink droplets while moving along the guide rail 16 in the primary scanning direction.

The object-to-be-printed holding member 18 is a holding member configured to hold objects to be printed, which are the 3-dimensional objects to be printed, and holds the 3-dimensional objects so that the surfaces to be printed of the 3-dimensional objects oppose the ink jet head 12. In this example, the object-to-be-printed holding member 18 is an attachment member configured to be mounted on a main body of the ink jet printer 10 as needed. Detailed configurations of the object-to-be-printed holding member 18 will be described further in detail later.

The holding portion drive unit 20 is a drive mechanism configured to move the object-to-be-printed holding member 18. In this example, the holding portion drive unit 20 moves the object-to-be-printed holding member 18, for example, in the direction of discharge of the ink droplets. The direction of discharge of the ink droplets means the direction in which the ink jet head 12 discharges ink droplets. In this example, the direction of discharge is a downward direction of gravitational force. In this configuration, the holding portion drive unit 20 adjusts a gap distance between the surfaces to be printed of the 3-dimensional objects (head gap) and the ink jet head 12. The holding portion drive unit 20 moves the object-to-be-printed holding member 18, for example, within a range on the order of 5 cm upward and downward.

In the adjustment of the gap distance, the holding portion drive unit 20 is preferably set so that the distance between the ink jet head 12 and the surface to be printed falls within a range from 1.0 to 1.5 mm, for example. In this configuration, printing on the 3-dimensional objects is achieved more adequately with great precision. The adjustment of the gap distance may be performed, for example, by moving the ink jet head 12. In this case, the holding portion drive unit 20 moves the object-to-be-printed holding member 18 relatively with respect to the ink jet head 12 by moving the guide rail 16, for example.

In this example, the holding portion drive unit 20 is capable of moving the object-to-be-printed holding member 18 both in the primary scanning direction and the secondary scanning direction. The secondary scanning direction is a direction orthogonal to the direction of discharge of ink droplets and the primary scanning direction. Accordingly, the holding portion drive unit 20 adjusts the positions of the 3-dimensional objects with respect to the ink jet head 12. In this example, the holding portion drive unit 20 also moves the holding portion drive unit 20 in the secondary scanning direction between the scanning actions of the ink jet head 12. Accordingly, the holding portion drive unit 20 feeds in sequence the 3-dimensional objects to be printed in the secondary scanning direction relatively to the ink jet head 12.

The control unit 22 is, for example, a CPU of the ink jet printer 10, and is configured to control an operation of each component of the ink jet printer 10 on the basis of an instruction received from an external host PC, a program or the like of a farm ware. For example, the control unit 22 controls positions of the 3-dimensional objects held by the object-to-be-printed holding member 18 by controlling the operation of the object-to-be-printed holding member 18. For example, the control unit 22 adjusts the positions of the 3-dimensional objects to be printed by controlling the operation of the holding portion drive unit 20. In addition, for example, the control unit 22 causes the ink jet head 12 to perform printing on the surfaces to be printed of the 3-dimensional objects by controlling the operations of the ink jet head 12 and the object-to-be-printed holding member 18.

Figure 2:
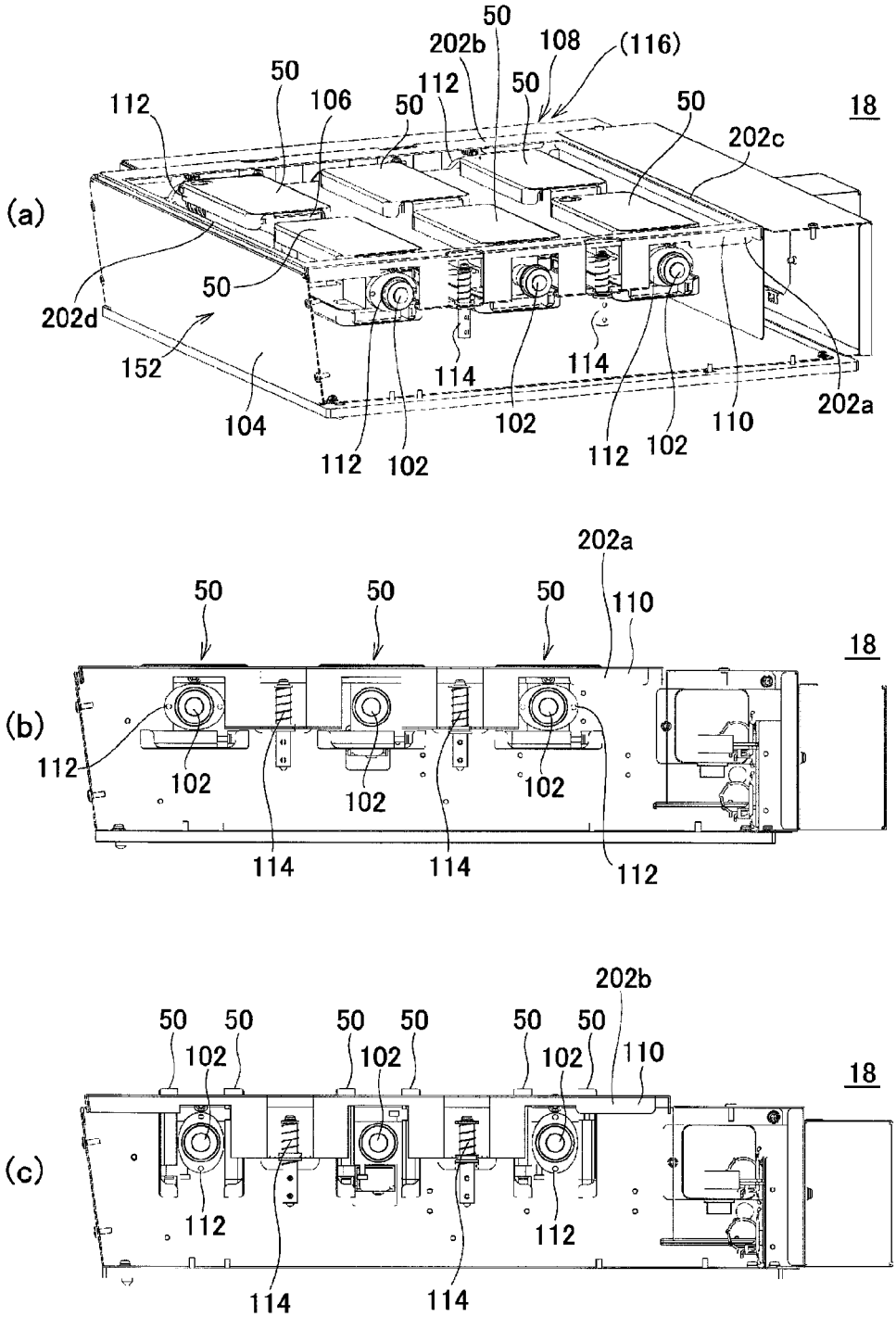

FIG. 1B is a drawing illustrating an example of a detailed configuration of the entire ink jet printer 10, and is a perspective view of the ink jet printer 10 in a state in which the holding portion drive unit 20 and the object-to-be-printed holding member 18 are pulled out of the main body of the ink jet printer 10. FIG. 2B illustrates an example of a state in which the object-to-be-printed holding member 18 and the like are mounted on the main body of the ink jet printer 10. In FIG. 2B, details of the object-to-be-printed holding member 18 are partly omitted or modified for the sake of convenience of illustration.

In this example, as the main body of the ink jet printer 10, for example, a UJF-3042HG type printing apparatus manufactured by MIMAKI ENGINEERING Co., Ltd. may be preferably used. This printing apparatus is an ink jet printer capable of printing on 3-dimensional objects placed in an area of 30 cm×42 cm. In this case, for example, the functions of the ink jet head 12, the ultraviolet irradiating portions 14, the guide rail 16, the holding portion drive unit 20, and the control unit 22 may be implemented by the function of the main body of this printing apparatus. The object-to-be-printed holding member 18 may be installed with great precision by using positioning hole portions or the like formed in a member corresponding to the holding portion drive unit 20. Furthermore, printing at high resolutions not lower than 600 dpi (for example, 720×600 dpi, 1,440×1,200 dpi), for example, is adequately performed. As described above, according to this example, printing on the 3-dimensional objects may be performed adequately with great precision.

Subsequently, detailed configurations of the object-to-be-printed holding member 18 will be described. FIGS. 2A to 2C and FIGS. 3A and 3B illustrate examples of detailed configurations of the object-to-be-printed holding member 18. FIGS. 2A to 2C are the drawings illustrating an example of a specific configuration of the object-to-be-printed holding member 18. FIG. 2A is a perspective view illustrating the example of the configuration of the object-to-be-printed holding member 18. FIGS. 2B and 2C are drawing for explaining the advancing and retracting operation of the light-shielding portion 110 of the object-to-be-printed holding member 18. In this example, the object-to-be-printed holding member 18 is a member configured to hold a plurality of the 3-dimensional objects 50 as the covers for the handheld terminals such as smart phones and includes a 3-dimensional object holding portion 152, a rotary drive unit 108, the light-shielding portion 110, a plurality of the ellipsoidal cams 112, and a plurality of guide shafts 114.

First of all, a configuration of the 3-dimensional object holding portion 152 will be described. The 3-dimensional object holding portion 152 has a configuration for holding the 3-dimensional objects 50 so as to oppose the ink jet head 12 (see FIG. 1). In this example, the 3-dimensional object holding portion 152 includes a plurality of the shaft members 102, a housing 104, and a plurality of work set members 106. The plurality of shaft members 102 are drive shafts configured to rotate the 3-dimensional objects 50 to bring the surfaces to be printed of the 3-dimensional objects 50 to oppose the ink jet head 12. In this example, the shaft members 102 are held by the housing 104 in a direction extending orthogonally to the direction of discharge of the ink droplets with the axial directions thereof parallel to each other. The direction in which the shaft members 102 extend may be, for example, the primary scanning direction. The direction in which the shaft members 102 extend may be the secondary scanning direction.

The housing 104 is a housing part of the object-to-be-printed holding member 18. In this example, the housing 104 is a box-shaped member opened on the side facing the ink jet head 12 at the time of printing, and holds one end and the other end of each of the shaft members 102 by two side surfaces opposing each other so as to be rotatable. Accordingly, the housing 104 functions as a shaft holding portion.

The housing 104 holds the plurality of shaft members 102 in a state in which the positions (heights) in the direction of discharge of the ink droplets are aligned. Shaft bearing portions of the housing 104, which support the one end and the other end of each of the shaft members 102, preferably have a configuration of a ball bearing. In this configuration, the shaft members 102 may be held more adequately.

Each of the plurality of work set members 106 is an example of a 3-dimensional object fixing member for installing the 3-dimensional object 50 to be printed at a printable predetermined position. In this example, each of the work set members 106 is fixed to the shaft member 102 in a state in which one of the shaft members 102 is penetrated therethrough, and fixes the 3-dimensional object 50 with respect to the shaft member 102. In this configuration, the work set members 106 rotate the 3-dimensional objects 50 together with the shaft members 102 in accordance with the rotation of the shaft members 102.

Here, in this example, the 3-dimensional object 50 as the cover for covering the back surface of the handheld terminal or the like has a main printing surface and a pair of side surfaces. The main printing surface is an example of the first surface to be printed. The pair of side surfaces intersect the main printing surface. One of the pair of side surfaces is an example of the second surface to be printed. The back side of the main printing surface of the 3-dimensional object 50 is opened for the sake of structure which covers the handheld terminal or the like.

In this example, each of the work set members 106 holds the 3-dimensional object 50 by holding at least part of an inner surface side of the 3-dimensional object 50. The inner surface of the 3-dimensional object is, for example, a back surface of the surface to be printed of the 3-dimensional object. More specifically, in this example, the work set member 106 has a portion having a shape corresponding to the handheld terminal which is an object that the 3-dimensional object 50 covers. The 3-dimensional object 50 having a cover shape is mounted on this part. Accordingly, the work set member 106 holds the 3-dimensional object 50.

Each of the work set members 106 holds two of the 3-dimensional objects 50 so that the back surfaces of the main printing surfaces of the two 3-dimensional objects 50 oppose each other with the shaft member sandwiched therebetween. Two of the work set members 106 are mounted on each of the shaft members 102. Therefore, according to this example, a number of the 3-dimensional objects 50 are adequately and simultaneously held by the object-to-be-printed holding member 18.

In this configuration, in the example, the 3-dimensional object holding portion 152 holds a plurality of the 3-dimensional objects 50. The surfaces to be printed of the 3-dimensional objects 50 facing the ink jet head 12 are changed by rotating the plurality of shaft members 102. Therefore, according to this example, adequate printing on the surfaces of the respective 3-dimensional objects 50 is achieved. In the illustrated configuration, the 3-dimensional object holding portion 152 has three shaft members 102. Therefore, in this example, the 3-dimensional object holding portion 152 holds twelve in total of the 3-dimensional objects 50 at maximum.

Subsequently, a configuration of the rotary drive unit 108 will be described. The rotary drive unit 108 is a drive unit configured to rotate the plurality of shaft members 102 and, for example, rotates the plurality of shaft members 102 according to an instruction received, for example, of the control unit 22 (see FIG. 1). In this example, the rotary drive unit 108 rotates the plurality of shaft members 102 keeping respective rotating angles aligned. Accordingly, the rotary drive unit 108 brings the same surfaces to be printed of the plurality of 3-dimensional objects 50 held by the 3-dimensional object holding portion 152 to oppose the ink jet head 12 simultaneously.

More specifically, the rotary drive unit 108 preferably includes, for example, a plurality of pulleys, a stepping motor, a timing belt, an angle detector, and the like. In this case, each of the plurality of pulleys is connected to one end of each of the plurality of shaft members 102, and rotates the shaft members 102 connected thereto by the rotation thereof. The stepping motor rotates according to, for example, the instruction received from the control unit 22. The timing belt connects the plurality of pulleys and the stepping motor to rotate the pulleys and the shaft members 102 according to the amount of rotation of the stepping motor. The angle detector detects the angle of rotation of the pulley.

In this configuration, by using the stepping motor and the timing belt for example, control of the angle of rotation of the shaft members 102 is performed adequately with great precision. In particular, the rotation of the shaft members 102 is stopped adequately with great precision at an angle at which the surfaces to be printed of the respective 3-dimensional objects 50 oppose the ink jet head 12. Therefore, in this configuration, for example, adequate printing with great precision is achieved on the surfaces to be printed of the respective 3-dimensional object 50. Accordingly, rotation of the plurality of shaft members 102 with higher adequacy is achieved.

In this example, the rotary drive unit 108 includes a ROM 116, which is a memory that memorizes information for correcting the angle of rotation of the shaft members 102. The ROM 116 memorizes amounts of displacement of readout results of the angle detector provided on the rotary drive unit 108 from a mounting position of the work set members 106 in the actual machine. For example, a rewritable non-volatile memory or the like may be used preferably as the ROM 116. Information memorized in the ROM 116 is read by the control unit 22 of the ink jet printer 10. The control unit 22 controls the angle of rotation of the shaft members 102 by performing correction, for example, according to the information memorized in the ROM 116. In this configuration, for example, the rotation of the shaft members 102 may be controlled with great precision.

When an attempt is made to perform printing on the 3-dimensional objects with great precision, there is a case where the gap distance between the surfaces to be printed and the ink jet head 12 needs to be set on the order of 1.0 to 1.5 mm. Therefore, mounting precisions of the respective members and precision of rotation of the shaft members 102 are desired to be set according to the gap distance. In contrast, according to this example, the shaft members 102 may be rotated with precision according to a narrow gap distance by correcting the angle of rotation by using the ROM 116. Accordingly, printing with great precision is adequately achieved.

In order to reduce the error in amount of rotation of the shaft members 102 and the work set members 106, it is important to set an initial position of the work set members 106 with great precision. In order to confirm the setting of the initial position, a method of overlapping a flat plate member on all of the work set members 106 on the 3-dimensional object holding portion 152 at the time of initial setting of the angle of rotation is effective. More specifically, for example, the plate member is overlapped on all of the work set members 106 in a state in which the surfaces of the work set members 106 corresponding to the main printing surfaces 302 of the 3-dimensional objects 50 oppose upward. Accordingly, for example, work set members 106 inclined with respect to other work set members 106 may be adequately found. In this configuration, the initial positions of all of the work set members 106 may also be set with great precision. In this case, the ROM 116 memorizes information indicating the initial positions, for example, as information for correcting the angle of rotation of the shaft members 102.

In this configuration, according to this example, the main printing surfaces of the 3-dimensional objects 50 and the side surfaces of the respective 3-dimensional objects 50 may be brought to oppose the ink jet head 12 adequately, for example, by rotating the plurality of shaft members 102. Also, adequate printing is achieved on all of the main printing surfaces and the side surfaces of the 3-dimensional objects 50 entirely.

Subsequently, configurations of the light-shielding portion 110, the plurality of ellipsoidal cams 112, and the plurality of guide shafts 114 will be described. The light-shielding portion 110 is a light-shielding plate for suppressing stray light generated by ultraviolet rays irradiated by the ultraviolet irradiating portions 14 (see FIG. 1). The light-shielding portion 110 is provided apart from the 3-dimensional objects 50 held by the 3-dimensional object holding portion 152 in the direction orthogonal to the direction of discharge of the ink droplets, and hence shields the ultraviolet rays proceeding to the outside of the object-to-be-printed holding member 18 in the periphery of the 3-dimensional objects 50. In this example, the light-shielding portion 110 is provided so as to be capable of advancing and retracting in the direction of discharge of ink droplets by the ink jet head 12. In this example, the ink jet head 12 discharges ink droplets in the direction of gravitational force. Therefore, "capable of advancing and retracting in the direction of discharge of ink droplets" means "capable of advancing and retracting in the vertical direction".

In this example, the light-shielding portion 110 includes first to fourth portions 202*a* to 202*d* as illustrated in FIG. 2A and so forth. Each of the first to fourth portions 202*a* to 202*d* are portions provided above the respective side surfaces of the housing 104. For example, the first portion 202*a* is a portion extending along the upper portion of the side surface of the housing 104 on one end side of the plurality of shaft members 102. The second portion 202*b* is a portion extending along the upper portion of the side surface of the housing 104 on the other end side of the plurality of shaft members 102. The third portion 202*c* and the fourth portion 202*d* are portions extending along the upper portion of the side surfaces of the housing 104 extending parallel to the shaft members 102, and connect the first portion 202*a* and the second portion 202*b*.

In this configuration, in this example, the light-shielding portion 110 is provided along the upper sides of the housing 104 to reduce the ultraviolet rays proceeding to the outside of the object-to-be-printed holding member 18. The light-shielding portion 110 shields the ultraviolet rays by, for example, the first to fourth portions 202*a* to 202*d* to shield the ultraviolet rays in four directions surrounding the periphery of the 3-dimensional objects 50. In this configuration, for example, stray light leaking to the position deviated from the 3-dimensional objects may be suppressed adequately in all the direction around the 3-dimensional objects 50.

The light-shielding portion 110 shields the ultraviolet rays by, for example, part of the first to fourth portions 202*a* to 202*d* to shield the ultraviolet rays in part of the four directions surrounding the periphery of the 3-dimensional objects 50. In this case, the light-shielding portion 110 preferably shields the ultraviolet rays in the fore-and-aft direction of the ink jet printer 10. The fore-and-aft direction of the ink jet printer 10 is directions to the front side and the back side of the ink jet printer 10. In this configuration, the ultraviolet rays toward a position where an operator (user) of the ink jet printer 10 often stands, of example, may be adequately shielded. Accordingly, the operator is adequately prevented from being irradiated with the leaked ultraviolet rays.

In this example, the first to fourth portions 202*a* to 202*d* of the light-shielding portion 110 are portions of a single continuing member as a whole. Therefore, the first to fourth portions 202*a* to 202*d* advance and retract in the vertical direction simultaneously in a state in which the relative position thereof is fixed. The advancing and retracting movement of the light-shielding portion 110 will be described in detail later.

The plurality of ellipsoidal cams 112 are an example of interlocking members configured to cause the light-shielding portion 110 to advance and retract in conjunction with the rotation of the shaft members 102. In this example, the ellipsoidal cams 112 are rotated by the rotation of the shaft members 102 by the shaft members 102 being inserted through the centers thereof. In this example, each of the ellipsoidal cams 112 is fitted to the shaft member 102 in an orientation in which a longitudinal axis extends in parallel to the main printing surface of the 3-dimensional object 50, and a short axis extends in parallel to the side surface of the 3-dimensional object 50. The ellipsoidal cams 112 are in abutment with the light-shielding portion 110 from the lower side, and are rotated in a state of being in contact with the light-shielding portion 110, thereby causing the light-shielding portion 110 to advance and retract in conjunction with the rotation of the shaft members 102.

More specifically, as illustrated in FIG. 2B, for example, when the ellipsoidal cams 112 come into abutment against the light-shielding portion 110 from the lower side on the short axis side, the light-shielding portion 110 is in a state of being lowered. In contrast, as illustrated in FIG. 2C, when the ellipsoidal cams 112 come into abutment with the light-shielding portion 110 from the lower side on the long axis side, the light-shielding portion 110 is in a state of being raised. Therefore, the light-shielding portion 110 may be advanced and retracted in the vertical direction by rotating the ellipsoidal cams 112 together with the shaft members 102.

In this example, the object-to-be-printed holding member 18 has four ellipsoidal cams 112. The four ellipsoidal cams 112 are, as illustrated, mounted on both ends of the two shaft members 102 arranged on the outsides out of the plurality of (three) shaft members 102 arranged in parallel. Among these cams, the ellipsoidal cams 112 on one side of the shaft members 102 come into contact with the first portion 202*a* of the light-shielding portion 110 from the lower side as illustrated in FIG. 2B and so forth. The ellipsoidal cams 112 on the other side of the shaft members 102 come into contact with the second portion 202*b* of the light-shielding portion 110 from the lower side as illustrated in FIG. 2C and so forth. Accordingly, the four ellipsoidal cams 112 come into contact with the light-shielding portion 110 on one side and the other side of the plurality of shaft members 102 and advance and retract the light-shielding portion 110 in the vertical direction according to the rotation of the shaft members 102. According to the example, the light-shielding portion 110 is capable of advancing and retracting more smoothly and more stably, for example, by advancing and retracting the light-shielding portion 110 while holding the same at four points.

The plurality of guide shafts 114 are an example of urging members urging the light-shielding portion 110 away from the ink jet head 12. In this example, the plurality of guide shafts 114 are provided in areas between the shaft members 102 on both end sides of the shaft members 102, and urge the light-shielding portion 110 upward by springs. In this configuration, for example, the light-shielding portion 110 may be advanced and retracted more adequately by the plurality of ellipsoidal cams 112.

In this configuration, according to the example, the light-shielding portion 110 may be advanced and retracted adequately depending on, for example, which surfaces of the 3-dimensional object 50 are surfaces to be printed. Accordingly, the stray light may be suppressed adequately.

As described above, according to the object-to-be-printed holding member 18 of this example, adequate printing may be performed simultaneously on a number of the 3-dimensional objects 50 by using the plurality of shaft members 102 and the plurality of work set members 106. Accordingly, reduction of the printing cost may be achieved. In this example, the four ellipsoidal cams 112 are disposed by effectively using the configuration in which the plurality of shaft members 102 are used. Accordingly, the light-shielding portion 110 is advanced and retracted more adequately to suppress the stray light. Therefore, it may be said that the configuration of this example allow suppression of the stray light more adequately by using a configuration specific for achieving the printing at low costs.

Figure 3:
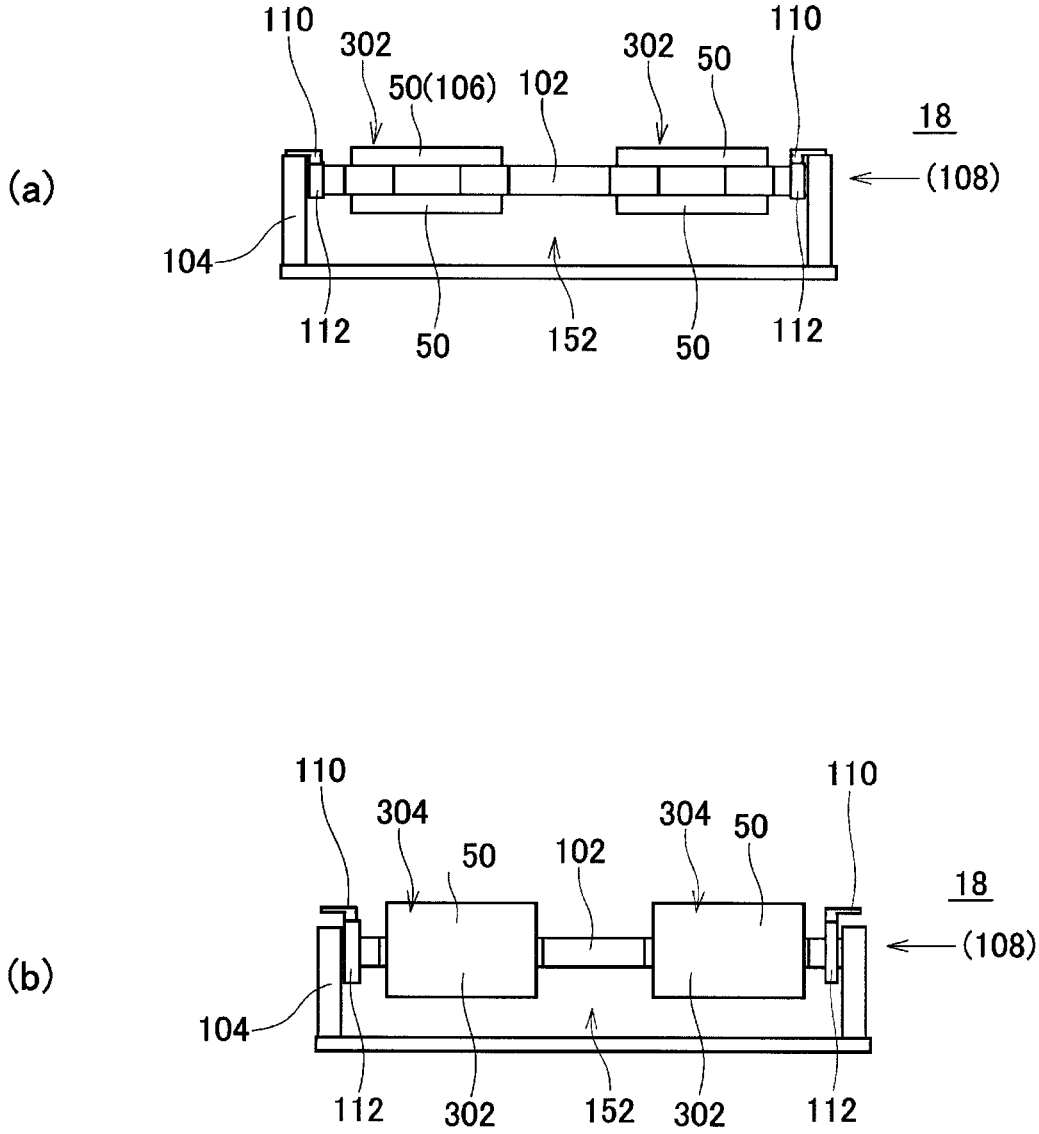

Subsequently, the rotation of the shaft members 102 and the advancing and retracting movement of the light-shielding portion 110 will be described further in detail. FIGS. 3A and 3B are drawings for explaining a state in which the light-shielding portion 110 advances and retracts in association with rotations of the shaft member 102 and the ellipsoidal cam 112. FIG. 3A is a drawing schematically showing a state illustrated in FIG. 2B viewed from the side, and illustrates an example of a state in which printing is performed on the main printing surfaces 302 of the 3-dimensional objects 50. FIG. 3B is a drawing schematically showing a state illustrated in FIG. 2C viewed from the side, and illustrates an example of a state in which printing is performed on the side surface 304 of the 3-dimensional objects 50.

As described with reference to FIGS. 2A to 2C, in this example, the 3-dimensional object holding portion 152 of the object-to-be-printed holding member 18 changes the orientation of the 3-dimensional objects 50 by rotating the shaft members 102, and changes the surfaces to be printed which are to be opposed to the ink jet head 12 (see FIG. 1). In the object-to-be-printed holding member 18 of this example, the positions of the surfaces to be printed in the vertical direction are changed by this rotation.

For example, as illustrated in FIG. 3A, when bringing the main printing surfaces 302 to oppose the ink jet head 12, the 3-dimensional object holding portion 152 holds the 3-dimensional objects 50 so that the position of the main printing surfaces 302 in the vertical direction matches a predetermined first opposed position. In this example, the first opposed position is almost the same as, or slightly higher than the upper sides of the side surfaces of the housing 104 of the object-to-be-printed holding member 18.

Also, as illustrated in FIG. 3B, when bringing the side surfaces 304 to oppose the ink jet head 12, the 3-dimensional object holding portion 152 holds the 3-dimensional objects 50 so that the position of the side surface 304 in the vertical direction matches a second opposed position, which is different from the first opposed position. In this example, the second opposed position is a position higher than the first opposed position in the vertical direction. Accordingly, when bringing the side surfaces 304 to oppose the ink jet head 12, the side surfaces 304 which are the surfaces to be printed project to a position higher than the side surfaces of the housing 104 of the object-to-be-printed holding member 18.

In this example, as described also by using FIGS. 2A to 2C, the light-shielding portion 110 configured to advance and retract in the vertical direction according to the rotation of the shaft members 102 and the ellipsoidal cams 112 is used. By this advancing and retracting movement, the light-shielding portion 110 shields the ultraviolet rays at different positions in the vertical direction depending on which one of the main printing surfaces 302 or the side surfaces 304 are the surfaces to be printed. Accordingly, the light-shielding portion 110 changes light-shielding areas which shield the ultraviolet rays depending on which one of the main printing surfaces 302 or the side surfaces 304 are the surfaces to be printed.

For example, when bringing the main printing surfaces 302 to oppose the ink jet head 12, as illustrated in FIG. 2B and FIG. 3A, the light-shielding portion 110 comes into abutment with the short axis side of the ellipsoidal cams 112. Accordingly, the light-shielding portion 110 shields the ultraviolet rays at a first light-shielding position in the vertical direction. In this example, the first light-shielding position is a light-shielding position which matches the position of the main printing surfaces 302 in a case where the main printing surfaces 302 are the surfaces to be printed.

When bringing the side surfaces 304 to oppose the ink jet head 12, as illustrated in FIG. 2C and FIG. 3B, the light-shielding portion 110 comes into abutment with the long axis side of the ellipsoidal cams 112. Accordingly, the light-shielding portion 110 shields the ultraviolet rays at a second light-shielding position which is higher than the first light-shielding position in the vertical direction. In this example, the second light-shielding position is a light-shielding position which matches the position of the side surfaces 304 in the case where the side surfaces 304 in question are the surfaces to be printed.

Here, in a case where the position of the surfaces to be printed changes by rotating the 3-dimensional object 50 in a printing process as this example, the gap distance, which is a distance between the ink jet head 12 and the surface to be printed is subject to a change only by simply rotating the 3-dimensional object 50. Consequently, it is conceivable that the stray light leaking from positions where the ultraviolet rays are deviated from the 3-dimensional object 50 is generated easily. Even when the distance between the ink jet head 12 and the surfaces to be printed is adjusted to fix the gap distance, as is understood from FIGS. 3A and 3B, and so forth, if the position of the surfaces to be printed of the 3-dimensional object 50 is changed in the vertical direction, it is conceivable that the stray light is generated due to the positional relationship with respect to the side surfaces of the housing 104 of the object-to-be-printed holding member 18.

In contrast, in this example, the light-shielding portion 110 may be advanced and retracted adequately so as to match the position of the surfaces to be printed which changes according to the rotation of the shaft members 102. Accordingly, the stray light may be suppressed adequately. Therefore, according to the example, when printing on the 3-dimensional objects 50 such as covers for handheld terminals is performed, the generation of stray light may be adequately suppressed. Accordingly, printing on the 3-dimensional objects 50 is performed further adequately.

Although the invention has been described with reference to the embodiment, a technical scope of the invention is not limited to the range described in the embodiment. It is apparent for those skilled in the art that a variety of modifications or improvements may be made. It is apparent from description in Claims that modes applied with such modifications or improvements are also included in the scope of the invention.

For example, as a method of changing the light-shielding area by the light-shielding portion, application of a method of changing the surface area of the light-shielding portion which contributes to the light shielding may also be applied. As regards the light-shielding portion, a configuration in which the ultraviolet rays are shielded only one of a case where the first surfaces to be printed are brought to oppose the ink jet head and a case where the second surfaces to be printed are brought to oppose the ink jet head and the light-shielding is not performed in the other case is also applicable.

The invention is preferably applied to, for example, an ink jet printer.

What is claimed is:

1. An ink jet printer configured to perform printing on a 3-dimensional object in an ink jet system comprising:

an ink jet head configured to discharge ink droplets of ultraviolet curing ink;

an ultraviolet irradiating portion configured to irradiate ultraviolet rays to cure the ultraviolet curing ink; and an object-to-be-printed holding member configured to hold the 3-dimensional object to be printed so as to oppose the ink jet head, wherein the 3-dimensional object to be printed includes at least a first surface to be printed as a surface to be printed by the ink jet printer and a second surface to be printed as a side surface of the first surface to be printed, the object-to-be-printed holding member includes:

a 3-dimensional object holding portion configured to hold the 3-dimensional object so as to oppose the ink jet head; and a light-shielding portion configured to reduce the ultraviolet rays proceeding to an outside of the object-to-be-printed holding member, the 3-dimensional object holding portion changes an orientation of the 3-dimensional object to bring the first surface to be printed and the second surface to be printed to oppose the ink jet head, when bringing the first surface to be printed to oppose the ink jet head, the 3-dimensional object holding portion holds the 3-dimensional object so that a position of the first surface to be printed in the direction of discharge as a direction in which the ink jet head discharges the ink droplets comes to a first opposed position, when bringing the second surface to be printed to oppose the ink jet head, the 3-dimensional object holding portion holds the 3-dimensional object so that a position of the second surface to be printed in the direction of discharge comes to a second opposed position different from the first opposed position, the light-shielding portion is provided apart from the 3-dimensional object held by the 3-dimensional object holding portion in the direction orthogonal to the direction of discharge, and hence shields the ultraviolet rays proceeding to the outside of the object-to-be-printed holding member in at least any one of directions in the periphery of the 3-dimensional object, and the light-shielding portion is provided so at to be capable of advancing and retracting in the direction of discharge at least at part of positions, the 3-dimensional object holding portion advances and retracts corresponding respectively to the first opposed position in a case where the 3-dimensional object holding portion brings the first surface to be printed to oppose the ink jet head and the second opposed position in a case where the second surface to be printed to oppose the ink jet head to change a light-shielding area that shields the ultraviolet rays in the direction orthogonal to the direction of discharge.

2. The ink jet printer according to claim 1, wherein in a case where the 3-dimensional object holding portion brings the first surface to be printed to oppose the ink jet head, the light-shielding portion shields the ultraviolet rays at a first light-shielding position in the direction of discharge, and in a case where the 3-dimensional object holding portion brings the second surface to be printed to oppose the ink jet head, the light-shielding portion shields the ultraviolet rays at a second light-shielding position different from the first light-shielding position in the direction of discharge.

3. The ink jet printer according to claim 1, wherein the 3-dimensional object holding portion includes:

a shaft member extending in the direction orthogonal to the direction of discharge;

a shaft holding portion configured to hold the shaft member so as to be rotatable; and a 3-dimensional object fixing member configured to fix the 3-dimensional object to the shaft member and rotates the 3-dimensional object together with the shaft member by being fixed to the shaft member, and the 3-dimensional object holding portion changes an orientation of the 3-dimensional object by rotating the shaft member to brings the first surface to be printed and the second surface to be printed to oppose to the ink jet head.

4. The ink jet printer according to claim 3, wherein the object-to-be-printed holding member further includes an interlocking member configured to advance and retract the light shielding portion in the direction of discharge in conjunction with the rotation of the shaft member.

5. The ink jet printer according to claim 4, wherein the interlocking member is an ellipsoidal cam configured to rotate according to the rotation of the shaft member by the shaft member inserted through the center thereof, and advance and retract the light-shielding portion in the direction of discharge in conjunction with the rotation of the shaft member by rotating in a state in contact with the light-shielding portion.

6. The ink jet printer according to claim 5, wherein the 3-dimensional object holding portion includes:

at least two shaft members arranged with axial directions parallel to each other; and at least two 3-dimensional object fixing members configured to fix the 3-dimensional objects to the shaft members, the object-to-be-printed holding member includes at least four ellipsoidal cams mounted to both ends of the at least two shaft members, and the light-shielding portion is in contact with the at least two ellipsoidal cams on one end side of the at least two shaft members and the at least two ellipsoidal cams on the other end side of the at least two shaft members, and advances and retracts in the direction of discharge according to the rotation of the at least four ellipsoidal cams.

7. The ink jet printer according to claim 5, wherein the object-to-be-printed holding member further includes an urging member configured to urge the light-shielding portion in the direction away from the ink jet head.

8. The ink jet printer according to claim 7, further comprising a corrected information memory configured to memorize information for correcting an angle of rotation of the shaft member.

9. The ink jet printer according to claim 2, wherein the 3-dimensional object holding portion includes:

a shaft member extending in the direction orthogonal to the direction of discharge;

a shaft holding portion configured to hold the shaft member so as to be rotatable; and a 3-dimensional object fixing member configured to fix the 3-dimensional object to the shaft member and rotates the 3-dimensional object together with the shaft member by being fixed to the shaft member, and the 3-dimensional object holding portion changes an orientation of the 3-dimensional object by rotating the shaft member to brings the first surface to be printed and the second surface to be printed to oppose to the ink jet head.

10. The ink jet printer according to claim 9, wherein the object-to-be-printed holding member further includes an interlocking member configured to advance and retract the light shielding portion in the direction of discharge in conjunction with the rotation of the shaft member.

11. The ink jet printer according to claim 10, wherein the interlocking member is an ellipsoidal cam configured to rotate according to the rotation of the shaft member by the shaft member inserted through the center thereof, and advance and retract the light-shielding portion in the direction of discharge in conjunction with the rotation of the shaft member by rotating in a state in contact with the light-shielding portion.

12. The ink jet printer according to claim 11, wherein the 3-dimensional object holding portion includes:

at least two shaft members arranged with axial directions parallel to each other; and at least two 3-dimensional object fixing members configured to fix the 3-dimensional objects to the shaft members, the object-to-be-printed holding member includes at least four ellipsoidal cams mounted to both ends of the at least two shaft members, and the light-shielding portion is in contact with the at least two ellipsoidal cams on one end side of the at least two shaft members and the at least two ellipsoidal cams on the other end side of the at least two shaft members, and advances and retracts in the direction of discharge according to the rotation of the at least four ellipsoidal cams.

13. The ink jet printer according to claim 6, wherein the object-to-be-printed holding member further includes an urging member configured to urge the light-shielding portion in the direction away from the ink jet head.

14. The ink jet printer according to claim 3, further comprising a corrected information memory configured to memorize information for correcting an angle of rotation of the shaft member.

15. The ink jet printer according to claim 4, further comprising a corrected information memory configured to memorize information for correcting an angle of rotation of the shaft member.

16. The ink jet printer according to claim 5, further comprising a corrected information memory configured to memorize information for correcting an angle of rotation of the shaft member.

17. The ink jet printer according to claim 6, further comprising a corrected information memory configured to memorize information for correcting an angle of rotation of the shaft member.

18. An object-to-be-printed holding member used in an ink jet printer configured to perform printing on a 3-dimensional object in an ink jet system by using ultraviolet curing ink and hold the 3-dimensional object to be printed so as to oppose an ink jet head, the object-to-be-printed holding member comprising:

a 3-dimensional object holding portion configured to hold the 3-dimensional object so as to oppose the ink jet head;

a light-shielding portion configured to reduce ultraviolet rays proceeding to an outside of the object-to-be-printed holding member, wherein the 3-dimensional object to be printed includes at least a first surface to be printed as a surface to be printed by the ink jet printer and a second surface to be printed as a side surface of the first surface to be printed, the 3-dimensional object holding portion changes an orientation of the 3-dimensional object to bring the first surface to be printed and the second surface to be printed to oppose the ink jet head, when bringing the first surface to be printed to oppose the ink jet head, the 3-dimensional object holding portion holds the 3-dimensional object so that a position of the first surface to be printed in the direction of discharge as a direction in which the ink jet head discharges the ink droplets comes to a first opposed position, when bringing the second surface to be printed to oppose the ink jet head, the 3-dimensional object holding portion holds the 3-dimensional object so that a position of the second surface to be printed in the direction of discharge comes to a second opposed position different from the first opposed position, the light-shielding portion is provided apart from the 3-dimensional object held by the 3-dimensional object holding portion in the direction orthogonal to the direction of discharge, and hence shields the ultraviolet rays proceeding to the outside of the object-to-be-printed holding member in at least any one of directions in the periphery of the 3-dimensional object, and the light-shielding portion is provided so at to be capable of advancing and retracting in the direction of discharge at least at part of positions, the 3-dimensional object holding portion advances and retracts corresponding respectively to the first opposed position in a case where the 3-dimensional object holding portion brings the first surface to be printed to oppose the ink jet head and the second opposed position in a case where the second surface to be printed to oppose the ink jet head to change a light-shielding area that shields the ultraviolet rays in the direction orthogonal to the direction of discharge.

19. A printing method configured to perform printing in an ink jet system on a 3-dimensional object using:

an ink jet head configured to discharge ink droplets of ultraviolet curing ink;

an ultraviolet irradiating portion configured to irradiate ultraviolet rays to cure the ultraviolet curing ink; and an object-to-be-printed holding member configured to hold the 3-dimensional object to be printed so as to oppose the ink jet head, wherein the 3-dimensional object to be printed includes at least a first surface to be printed as a surface to be printed by the ink jet printer and a second surface to be printed as a side surface of the first surface to be printed, the object-to-be-printed holding member includes:

a 3-dimensional object holding portion configured to hold the 3-dimensional object so as to oppose the ink jet head; and a light-shielding portion configured to reduce the ultraviolet rays proceeding to an outside of the object-to-be-printed holding member, the 3-dimensional object holding portion changes an orientation of the 3-dimensional object to bring the first surface to be printed and the second surface to be printed to oppose the ink jet head, when bringing the first surface to be printed to oppose the ink jet head, the 3-dimensional object holding portion holds the 3-dimensional object so that a position of the first surface to be printed in the direction of discharge as a direction in which the ink jet head discharges the ink droplets comes to a first opposed position, when bringing the second surface to be printed to oppose the ink jet head, the 3-dimensional object holding portion holds the 3-dimensional object so that a position of the second surface to be printed in the direction of discharge comes to a second opposed position different from the first opposed position, the light-shielding portion is provided apart from the 3-dimensional object held by the 3-dimensional object holding portion in the direction orthogonal to the direction of discharge, and hence shields the ultraviolet rays proceeding to the outside of the object-to-be-printed holding member in at least any one of directions in the periphery of the 3-dimensional object, and the light-shielding portion is provided so at to be capable of advancing and retracting in the direction of discharge at least at part of positions, the 3-dimensional object holding portion advances and retracts corresponding respectively to the first opposed position in a case where the 3-dimensional object holding portion brings the first surface to be printed to oppose the ink jet head and the second opposed position in a case where the second surface to be printed to oppose the ink jet head to change a light-shielding area that shields the ultraviolet rays in the direction orthogonal to the direction of discharge.

* * * * *